US005967761A

United States Patent [19]

Mehaffey

[11] Patent Number: 5,967,761

[45] Date of Patent: Oct. 19, 1999

[54] METHOD FOR MODULATION LAG COMPRESSOR IN MULTIPLE COMPRESSOR SYSTEM

[75] Inventor: James D. Mehaffey, Mooresville, N.C.

[73] Assignee: Ingersoll-Rand Company, Woodcliff Lake, N.J.

[21] Appl. No.: 08/892,839

[22] Filed: Jul. 15, 1997

[51] Int. Cl.[6] ..... F04B 49/00

[52] U.S. Cl. ..... 417/286; 417/53; 417/298

[58] Field of Search ..... 417/286, 298, 417/295, 53; 418/201.2

[56] References Cited

U.S. PATENT DOCUMENTS

| | | | |
|---|---|---|---|
| 3,535,053 | 10/1970 | Jednacz . | |
| 3,775,995 | 12/1973 | Conley et al. | 62/196 |
| 3,778,192 | 12/1973 | Caffrey | 417/286 |
| 3,961,862 | 6/1976 | Edstrom et al. | 417/295 |
| 4,212,599 | 7/1980 | Lantermann | 417/295 |
| 4,227,862 | 10/1980 | Andrew et al. . | |
| 4,249,866 | 2/1981 | Shaw et al. . | |
| 4,502,842 | 3/1985 | Currier et al. | 417/53 |
| 4,560,319 | 12/1985 | Blotenberg | 417/286 |
| 4,640,665 | 2/1987 | Staroselsky et al. | 417/286 |
| 4,807,150 | 2/1989 | Hobbs . | |
| 5,054,995 | 10/1991 | Haseley et al. . | |
| 5,231,846 | 8/1993 | Goshaw et al. | 417/8 |
| 5,343,384 | 8/1994 | Fisher et al. | 417/8 |

*Primary Examiner*—Timothy S. Thorpe
*Assistant Examiner*—Cheryl J. Tyler
*Attorney, Agent, or Firm*—Michael M. Gnibus

[57] ABSTRACT

A method for controlling modulation of at least one compressor in a compressor system includes the steps of providing a host controller including a microprocessor for controlling overall operation of the compressor system. The host controller includes a microprocessor and memory for storing system values and transmitting load, unload and modulation commands to the at least one compressor. The at least one compressor includes a compressor controller having a microprocessor in communication with the host controller, a discharge port for discharging compressed fluid from the compressor, and a pressure sensor in communication with the discharge port for sensing the pressure of the compressed fluid discharged therefrom. The sensor is in signal sending relation with the compressor controller. The method also includes transmitting a modulation command from the host controller to the compressor controller of the at least one compressor upon the occurrence of a predetermined event. After the at least one compressor receives the modulation signal, the local controller establishes a modulation range for the at least one compressor including sensing the pressure of the compressed fluid discharged from the at least one compressor, transmitting the sensed pressure signal to the compressor controller of the at least one compressor, and establishing the modulation range of the at least one compressor based upon the sensed pressure signal.

17 Claims, 5 Drawing Sheets

METHOD FOR MODULATION LAG COMPRESSOR IN MULTIPLE COMPRESSOR SYSTEM

BACKGROUND OF THE INVENTION

The invention relates to a method for controlling modulation of a lag compressor in a multiple compressor system, and more particularly to a method for controlling modulation of a lag compressor in a multiple compressor system wherein the pressure that the lag compressor is modulated around is determined by the actual lag compressor discharge pressure.

Conventional host controlled compressor systems are comprised of at least two compressors which together supply a compressed fluid at a required supply pressure, to meet the demand for use of the compressed fluid in the facility where the host controlled compressor system is located. Operation of the compressors is controlled by a microprocessor based host controller. Generally, the host controller receives signals from a supply line pressure sensor and compares the actual supply line pressure to a predetermined required supply line operating pressure range or pressure bandwidth, to determine whether it is necessary to modulate any of the system compressors.

In such conventional compressor systems, one or more of the compressors is designated the system lead compressor and one or more of the compressors is designated the lag compressor of the system. During operation of the conventional compressor system, the supply line pressure fluctuates primarily because of changes in the demand for the compressed fluid. As a result, it is necessary from time to time to modulate one or more of the system compressors in order to maintain the required system supply line pressure. The lag compressor is typically the system compressor that is modulated by cycling the lag compressor between fully loaded (100%) operation and unloaded (0%) operation.

The known method for modulating a compressor system is more fully explained by the following illustrative compressor system. FIG. 1 is a schematic representation of a conventional multiple compressor system 10 comprised generally of host controller 11, lead compressor 12, lag compressor 13, and supply line pressure sensor 14 which is flow connected to compressed fluid supply line 15. In the illustrative system 10, the compressed air demand requires that the lead compressor 12 be operated continuously, fully loaded, and that the lag compressor be modulated between unloaded and fully loaded operation.

During operation of system 10, the determination when to modulate the lag compressor is made by the host controller 11 and is based on the supply line pressure sensed by sensor 14. The host controller compares the actual sensed supply line pressure with the predetermined set point supply line pressure range stored in the host controller. When the supply line pressure is outside the acceptable supply line pressure range and is greater than the acceptable set point supply line pressure, the host controller sends a signal to lag compressor 13 and unloads the compressor until the actual supply line pressure is within the acceptable supply line pressure range. Lead compressor 12 remains fully loaded.

When the actual supply line pressure is outside the acceptable supply line pressure range and is less than the acceptable supply line pressure the host controller 11 sends a signal to the lag compressor 13 to fully load the lag compressor, and the lag compressor runs fully loaded until the actual supply line pressure is within the acceptable operating range. Then the host controller unloads the lag compressor. When the lag compressor is fully loaded, the lead compressor remains fully loaded.

This conventional method of modulating the lag compressor 13 by cycling between loaded and unloaded operation is repeated continuously during operation of the multiple compressor system 10.

There are a number of problems associated with the known method of modulating a lag compressor. First, modulation around the system supply line pressure may be inaccurate and is a complicated. System pressure drops may occur between the compressor discharge port and the supply line pressure sensor due to dryers or separator tanks which are flow connected to the supply line. If the lag compressor is modulated around the supply line pressure, the losses between the supply line sensor and lag compressor discharge must be considered in order to modulate the lag compressor effectively and accurately. The requirement that such losses be taken into account when modulating increases the complexity of the host controller logic and more data must be transferred between the host controller and the lag compressor. In a compressor system comprised of a large number of compressors, analysis and consideration of supply line losses can be quite burdensome.

Second, the benefits and efficiencies associated with state of the art precisely positionable inlet valves are not realized in a conventional, host controlled multiple compressor system that is modulated by cycling the lag compressors between fully loaded and unloaded operation.

Third, failure of mechanical and electrical components associated with loading and unloading of the compressor is accelerated as a result of the continuous, repetitive starting and stopping during compressor modulation.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a method for controlling modulation of a lag compressor in a compressor system, the method comprising the steps of transmitting a modulation signal from a host controller to the lag compressor; sensing the lag compressor discharge pressure; setting the modulation range for the lag compressor based on the sensed lag compressor discharge pressure; and modulating the lag compressor around the modulation range.

The foregoing and other aspects will become apparent from the following detailed description of the invention when considered in conjunction with the accompanying drawing figures.

DESCRIPTION OF THE DRAWING FIGURES

DESCRIPTION OF THE PREFERRED EMBODIMENT

Generally, the present invention relates to a method for modulating the lag compressor in a compressor host controlled system comprised of at least two compressors where the demand for compressed air does not require that all of the compressors be fully loaded continuously. One of the system compressors is designated a lag compressor that is modulated in accordance with the present invention during system operation, and the other system compressor or compressors are designated lead compressors that operate continuously, fully loaded.

Figure 1:
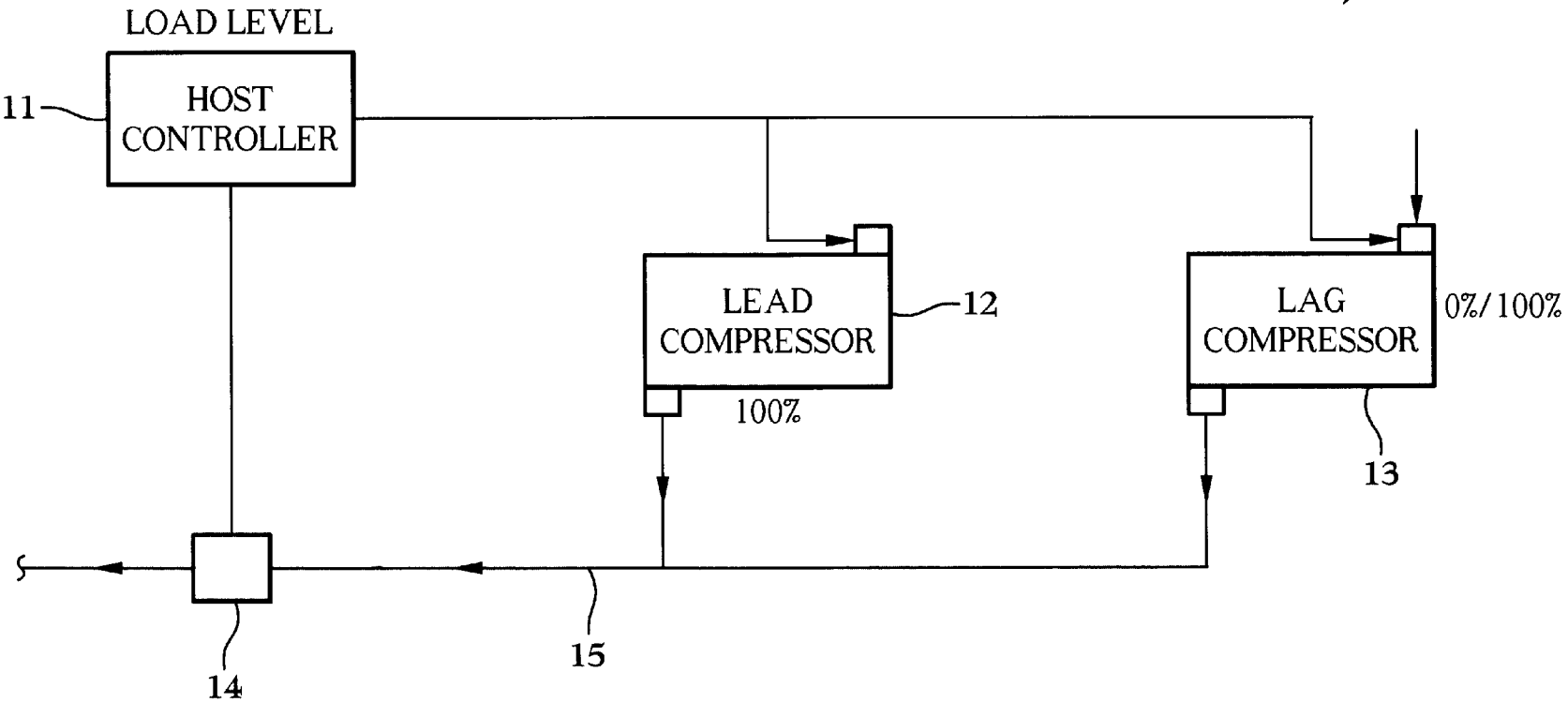
Fig. 1 (Prior Art)
FIG. 1 is a schematic representation of a conventional multiple compressor host controlled system.
Figure 2:
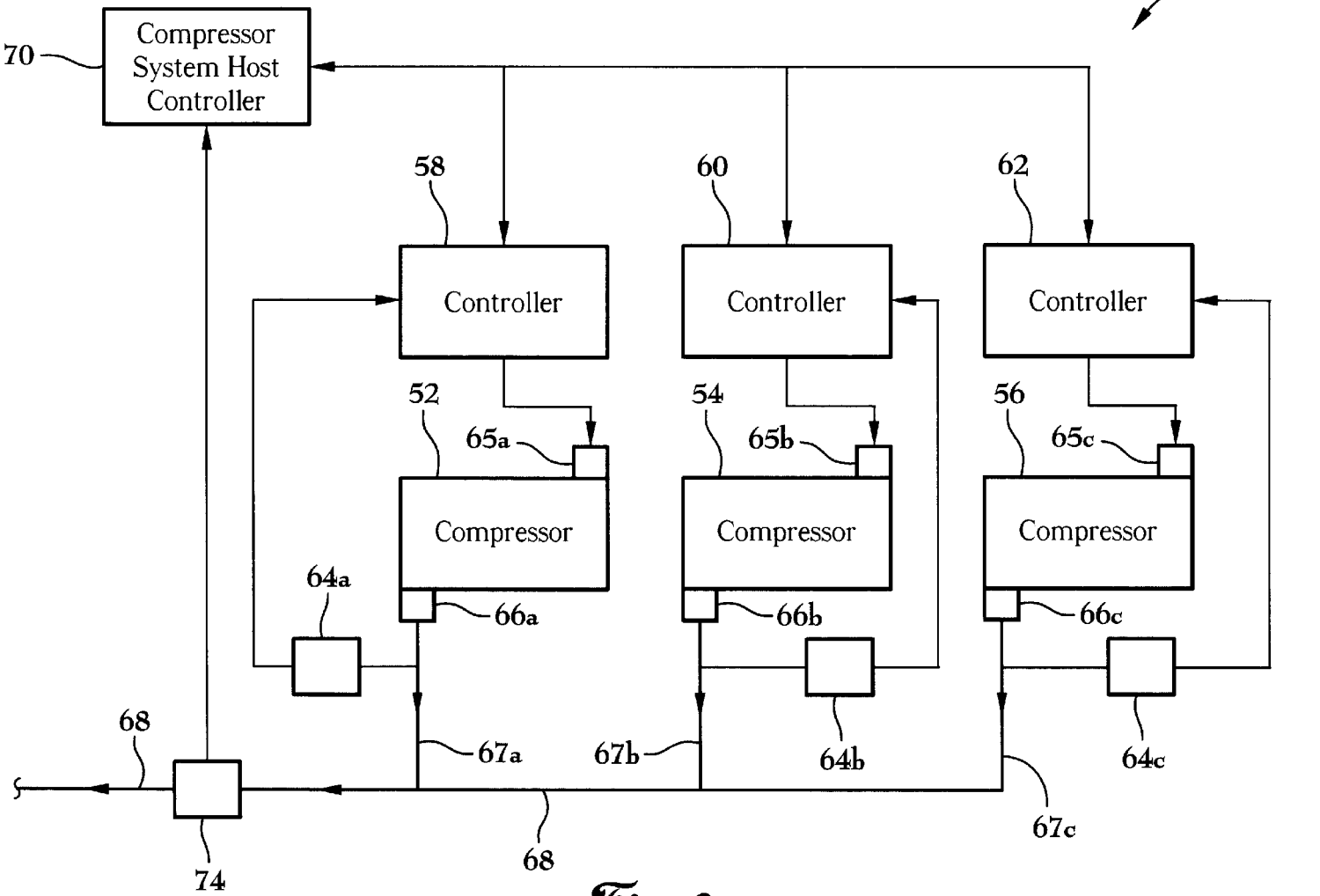
FIG. 2 is a schematic representation of a multiple compressor host controlled system that utilizes the present invention method for modulating the compressor system lag compressor.
Figure 3A:
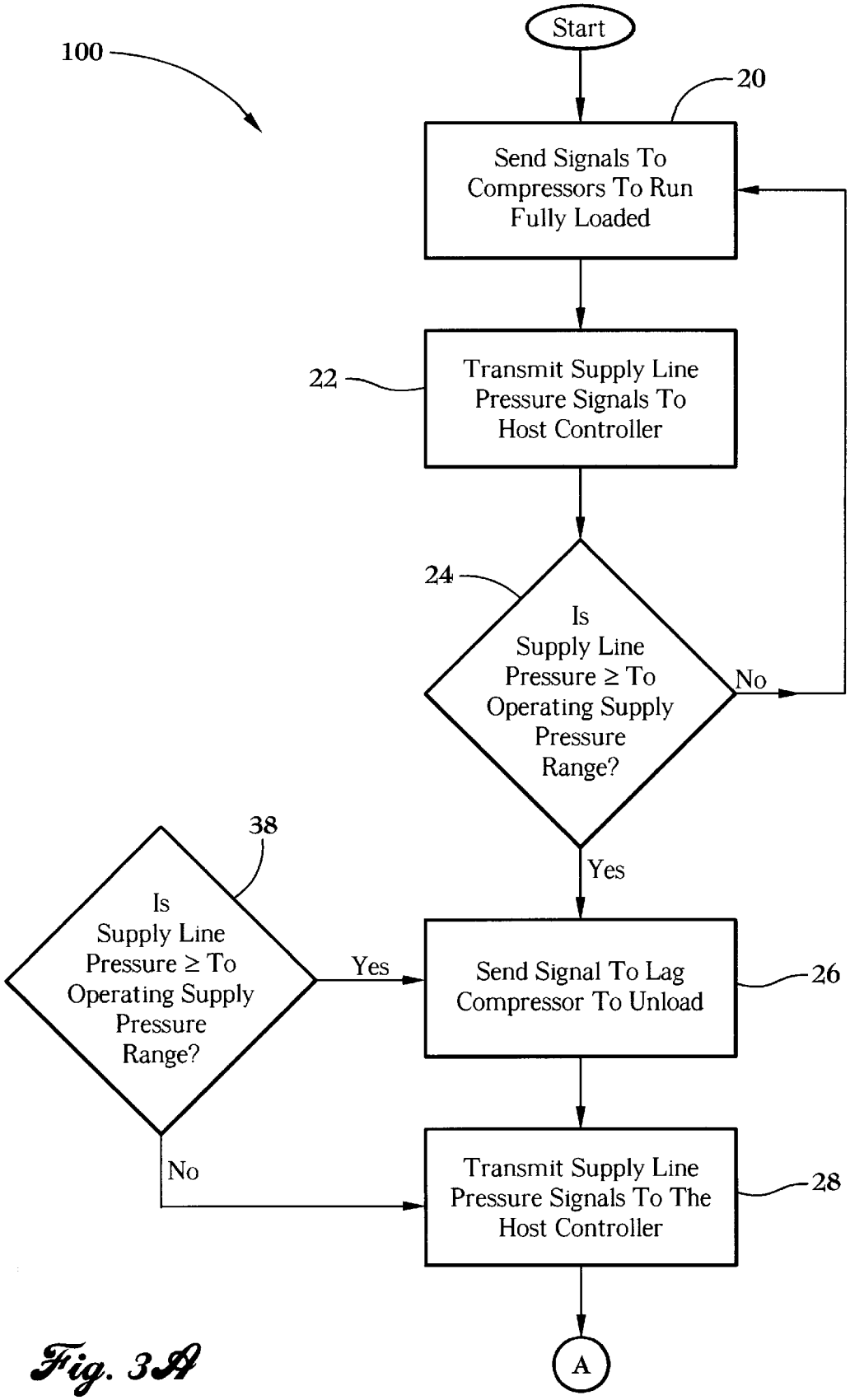
FIGS. 3*a,* 3*b,* and 3*c* are flowchart representations which together illustrate the logic of the present invention method for modulating the compressor system lag compressor.

Turning now to the Figures wherein like components and method steps are referred to by the same numbers in the Figures, FIGS. 2 and 3*a,* 3*b,* and 3*c* disclose the present invention method for modulating the compressor system lag compressor. Compressor system designated generally at 50 in FIG. 2 is a host system controlled by compressor system host controller 70 and includes three fluid compressors 52, 54, and 56. Although three compressors are disclosed in system 50, it should be understood that system 50 may include any number of compressors provided the system includes at least one lead compressor and at least one lag compressor. As the description proceeds, compressors 52 and 54 shall be referred to as the lead compressors and compressor 56 shall be referred to as the lag compressor. In order to practice the method of the present invention, only one of the compressors that comprise any multiple compressor system may be designated the lag compressor and all of the other compressors comprising the system shall be designated lead compressors. Additionally, each of the compressors 52, 54, and 56 must be a positive displacement compressor such as a rotary screw compressor of the type that is well known to one skilled in the pertinent art.

The operation of each compressor is monitored by a respective compressor controller 58, 60, and 62. The controllers are microprocessor based controllers well known to one skilled in the art, and during operation of system 50 the controllers receive and process compressor operating parameter signals from a plurality of compressor diagnostic sensors. More particularly, the controllers 58, 60, and 62 receive signals from discharge pressure sensors 64*a,* 64*b,* and 64*c* which sense the pressure of the compressed fluid discharged from discharge ports 66*a,* 66*b,* and 66*c* to discharge flow lines 67*a,* 67*b,* and 67*c*. The flowlines are flow connected to main supply line 68 which may be flow connected to a receiver tank or object of interest such as a pneumatic tool (both not shown). Uncompressed ambient air is flowed into the compressors through inlet valves 65*a,* 65*b,* and 65*c* that include a means for repositioning the inlet valves to adjust the volume of air supplied to the respective compressor.

Compressor controllers 58, 60, and 62 are electrically connected in signal receiving relation with discharge pressure sensors 64*a,* 64*b,* and 64*c*. The compressor system host controller 70 and the compressors inlet valves 65*a–c* are electrically connected in signal receiving relation with the controllers 58–62; and the compressor host controller 70 is located in signal receiving relation with both supply line pressure sensor 74 flow connected in supply line 68, and compressor controllers 58, 60, and 62.

Like compressor controllers 58–62, the compressor system host controller 70 is a microprocessor based controller well 10 known to one skilled in the art. All of the controllers 58–62, and 70 include a conventional memory. A predetermined acceptable supply pressure range for compressor system 50 is stored in the host controller memory. During operation of the method of the present invention, the actual supply pressure sensed by supply line sensor 74 is compared with the predetermined acceptable supply pressure range or pressure bandwidth, stored in the host controller memory, to determine if the lag compressor should be loaded, unloaded, or modulated.

Modulation of the lag compressor 56 of compressor system 50 will now be described.

Routine 100 is shown in FIGS. 3*a,* 3*b,* and 3*c,* and is stored in host controller memory. Referring to FIG. 3*a,* upon startup of compressor system 50, in step 20, one-by-one, the host controller sends fully load signals to lead compressors 52, 54, and to lag compressor 56. Compressor 52 is loaded first, followed by lead compressor 54 and the lag compressor 56 is the last compressor that is fully loaded. As the compressors are fully loaded in step 20, the host controller 70 receives supply line pressure signals from sensor 74 in step 22. In step 24 the host controller compares the actual supply line pressure with the predetermined operating supply line pressure range stored in the host controller memory. If in step 24, the actual supply line pressure is below the operating supply line pressure range, the routine 100 returns to step 20 and continues to load the compressors. If in step 24, the actual supply line pressure is greater than or equal to the operating supply line pressure range, the routine proceeds to step 26 and a signal is sent to the lag compressor to unload.

The host controller 70 continues to receive supply line pressure signals from sensor 74, in step 28.

Figure 3B:
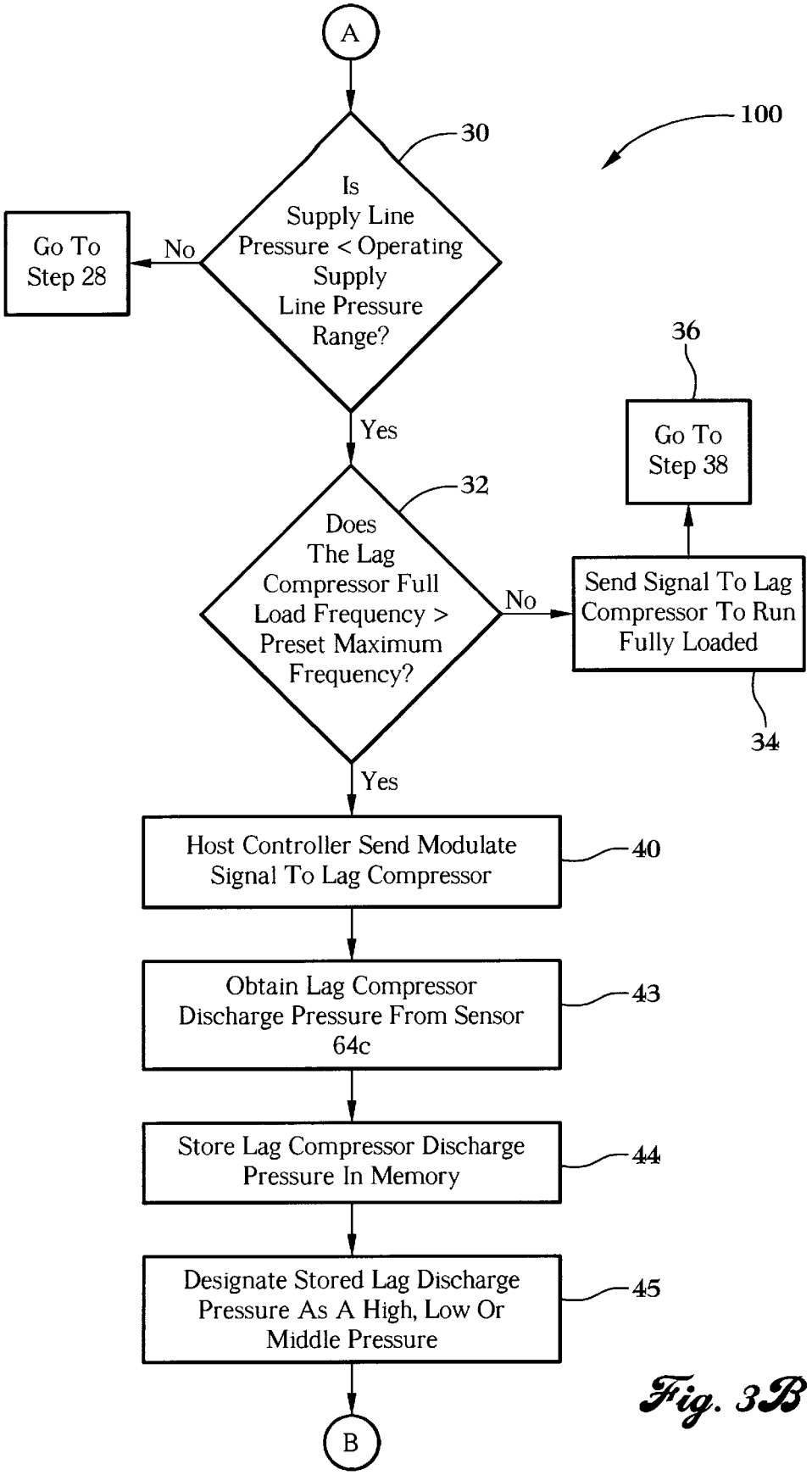

In step 30 on FIG. 3*b,* if the supply line pressure is lower than the acceptable operating supply line pressure range, the lag compressor remains fully loaded and the routine returns to step 28. If in step 30, the actual supply line pressure is greater than or equal to the acceptable operating supply line pressure range, the routine 100 proceeds to step 32 to determine whether or not the lag compressor should be modulated or unloaded.

In decision step 32 the routine determines if the actual frequency of lag compressor loading exceeds a predetermined acceptable loading frequency stored in the host controller memory. If in step 32 it is determined that the predetermined acceptable loading frequency has not been exceeded, the routine proceeds to step 34 and in step 34 a signal is sent to the lag compressor to run fully loaded. The routine then branches to step 38. In step 38, the supply line pressure is compared with the operating supply pressure range as previously described in steps 24 and 30, and if the acceptable supply line pressure range is exceeded a signal is sent to the lag compressor to unload in step 26. If in step 38 the actual supply line pressure is below the acceptable operating supply pressure range, the routine returns to step 28.

If in step 32, the lag compressor load frequency exceeds the predetermined acceptable loading frequency, the routine proceeds to step 40 and in step 40 a signal is sent by the host controller 70 to the lag compressor controller 62 to modulate. The modulate command is different than the load command sent by the host in conventional host controlled compressor systems. The modulate signal causes the lag compressor to modulate over a range that represents a percentage of the compressor capacity rather than simply loading and unloading the lag compressor conventionally.

Upon receiving the modulate signal from the host controller 70, the lag compressor controller 62 obtains the lag compressor discharge pressure from sensor 64*c,* in step 43. In step 44 the value obtained in step 43 is stored in the lag compressor controller memory and then in step 46, the lag compressor modulates around the lag compressor discharge pressure value stored in memory of compressor 56.

The discharge pressure stored in lag compressor controller memory in step 44 is designated either as a low modulation pressure value, a high modulation pressure value or a middle modulation pressure value. See step 45. The system may modulate around the specific stored pressure or may modulate around a pressure range or bandwidth.

Figure 3C:
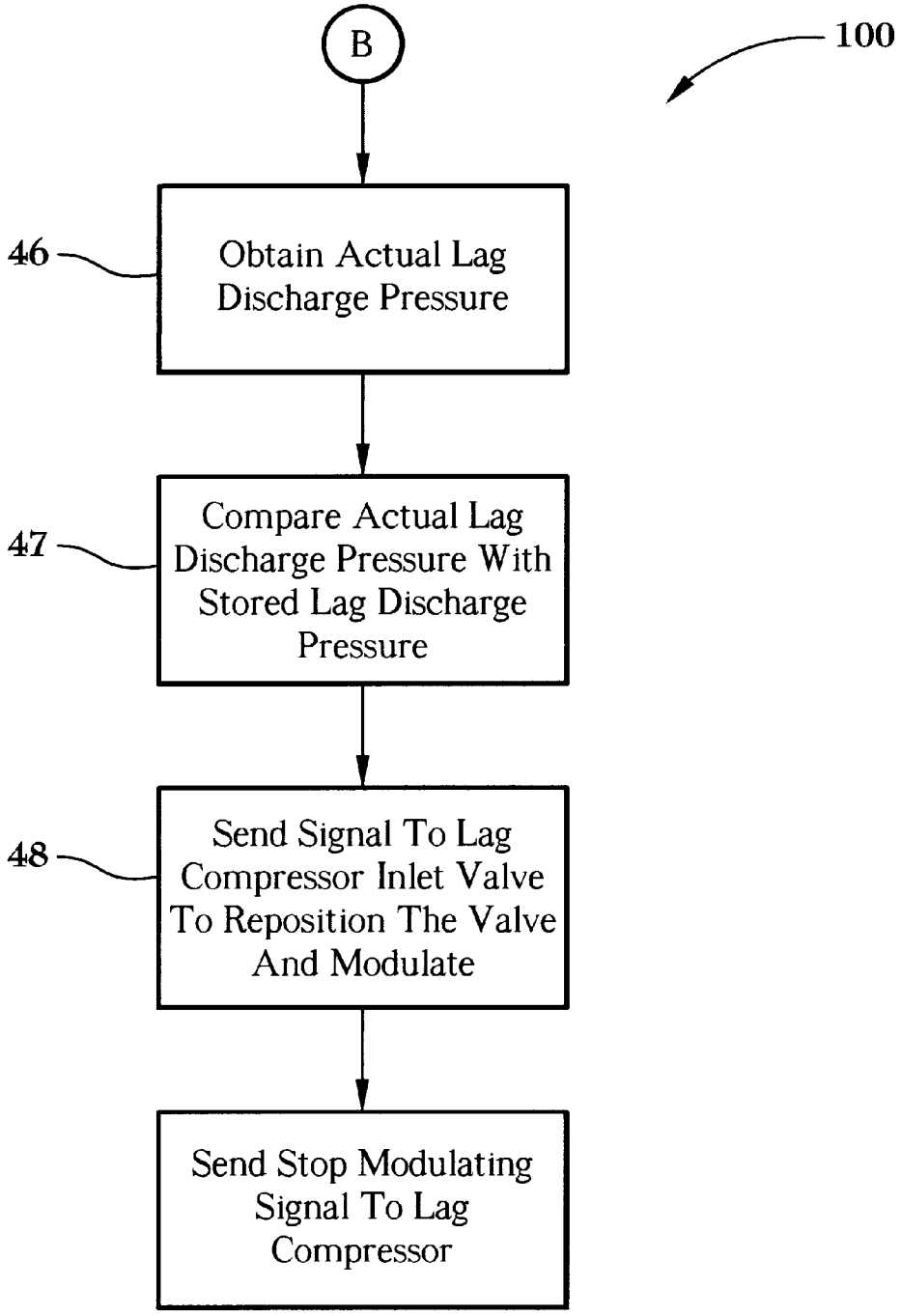

FIG. 3*c* will be referred to during the following further description of the modulation of the lag compressor. During modulation of the lag compressor, the actual lag compressor discharge pressure signals are sent from sensor 64*c* to the lag compressor controller 62 the actual lag compressor discharge pressure is compared with the stored modulation pressure in step 47. Depending on the designation assigned the modulation discharge pressure in step 45, the comparison will cause the inlet valve 65*c* to be opened or closed by the controller 62. For example, if the stored pressure that the lag compressor is to modulate around is designated a middle pressure value, and the actual discharge pressure is greater than the stored discharge pressure, the controller 62 will send a close signal to the inlet valve 65*c* to bring the actual pressure value closer to the middle pressure value. Conversely, if the actual discharge pressure is less than the stored discharge pressure, the controller will send an open signal to the inlet valve in step 48 to open the inlet valve 65*c* and increase the actual discharge pressure.

If the stored modulation discharge pressure is designated a low pressure value and the actual lag compressor discharge pressure increases beyond the modulation range, the controller will send a close signal to the inlet valve 65*c* and decrease the actual discharge pressure. If the actual discharge pressure is decreasing below the modulation range, the controller will send an open signal to the inlet valve to increase the actual discharge pressure.

Finally, if the stored modulation discharge pressure is designated as a high discharge pressure and the actual discharge pressure is less than the high discharge pressure range, the controller will send a signal to the inlet valve 65*c* to open and increase the actual discharge pressure. If the actual discharge pressure is increasing beyond the high discharge pressure, the controller will send a close signal to the inlet valve 65*c* to modulate and decrease the actual discharge pressure.

In this way, the lag compressor may be modulated over a modulation range based on the actual lag compressor discharge pressure, rather than modulating by loading and unloading the lag compressor based on the supply line pressure.

During operation of routine 100 modulation steps 40–47, the lead compressors are running fully loaded, and the lag compressor is modulated around the lag compressor discharge pressure range or pressure point stored in memory step 44.

The host controller continuously compares the supply line pressure with the stored acceptable supply line pressure value and after the lag compressor is modulated to the required pressure, and the host controller determines that the supply pressure is acceptable, it sends a signal to the lag compressor to stop modulating. The host controller stops the lag compressor from modulating by sending an unload or fully load command to the lag compressor controller.

When the supply line pressure again falls outside the required operating range, the routine 100 again modulates the lag compressor in the manner previously described beginning at step 40.

In summary, the lag compressor is not loaded and unloaded as in conventional modulation methods, but rather is modulated around a high, low or middle modulation discharge pressure. In this way, accurate, efficient modulation is achieved. It is not necessary to consider downstream pressure losses and advanced inlet valve technology may be utilized to achieve precise valve positioning within the designated modulation range. Accelerated wear of the mechanical and electrical parts is prevented.

The host system can easily change the modulation pressure range of the lag compressor by simply issuing a new modulation command to the lag compressor. The compressor, upon receiving the new command, would then obtain a new discharge pressure reading from sensor 64*c* and then would determine the new modulation pressure range. This is useful if the host system requires the system pressure be raised or lowered during operation.

While I have illustrated and described a preferred embodiment of my invention, it is understood that this is capable of modification, and I therefore do not wish to be limited to the precise details set forth, but desire to avail myself of such changes and alterations as fall within the purview of the following claims.

Having described the invention, what is claimed is:

1. A method for controlling modulation of at least one compressor in a compressor system comprising the steps of:

providing a host controller including a microprocessor for controlling overall operation of said compressor system and transmitting load, unload and modulation commands to said at least one compressor, said at least one compressor comprising:

a compressor controller including a microprocessor in communication with said host controller, a discharge port for discharging compressed fluid from said compressor, and a pressure sensor in communication with said discharge port for sensing the pressure of the compressed fluid discharged therefrom, the sensor being in signal sending relation with the compressor controller;

transmitting a modulation command from said host controller to the compressor controller of said at least one compressor upon the occurrence of a predetermined event;

after the transmitting a modulation command step, establishing a modulation range for said at least one compressor including:

sensing the pressure of the compressed fluid discharged from said at least one compressor, transmitting the sensed pressure signal to the compressor controller of said at least one compressor, and establishing the modulation range of said at least one compressor based upon the sensed pressure signal.

2. The method as claimed in claim 1, further comprising the steps of:

sensing the aggregate pressure of the compressed fluid discharged from said at least one compressor;

transmitting the sensed aggregate pressure to said host controller, wherein said host controller compares the sensed aggregate pressure to a set point pressure range stored therein;

transmitting an unload command from said host controller to said at least one compressor if said sensed aggregate pressure is above said set point pressure range;

transmitting a load command from said host controller to said at least one compressor if said sensed aggregate pressure is below said set point pressure range, wherein said host controller transmits the modulation signal from said host controller to said at least one compressor if said host controller determines that two or more load commands have been transmitted to said at least one compressor within a predetermined time period.

3. The method as claimed in claim 2, wherein the compressor system includes a main supply line for receiving the compressed fluid discharged from said at least one compressor and a main supply line pressure sensing means for sensing the pressure of the compressed fluid flowing through the main supply line, said main supply line pressure sensing means being in signal transmitting relation with the host controller, the sensing the aggregate pressure of the compressed fluid discharged from said two or more compressors step comprising the steps of: sensing the pressure of the compressed fluid flowed through the main supply line; and transmitting the sensed main supply line pressure signal to the host controller.

4. The method as claimed in claim 3, further comprising the step of comparing the sensed main supply line pressure signal with a predetermined operating pressure range and if the sensed main supply line pressure signal is below the predetermined operating pressure range, then transmitting a load signal from the host controller to the next highest ranked idle compressor.

5. The method as claimed in claim 1, further comprising the step of loading the lowest ranked compressor at least twice within a predetermined period of time before transmitting a modulation signal from said host controller to the lowest ranked compressor.

6. The method as claimed in claim 1, further comprising the steps of:

storing an acceptable set point frequency for loading the lowest ranked compressor at least twice within the predetermined period of time; and comparing the actual frequency of loading the lowest ranked compressor at least twice to the acceptable set point frequency, wherein if the actual loading frequency is greater than the acceptable set point frequency, then transmitting a modulation signal from the host controller to the lowest ranked compressor.

7. The method as claimed in claim 1, further comprising the step of running each said compressor that has received the load command in a fully loaded condition.

8. The method as claimed in claim 1, wherein the at least one compressor includes a rotary screw compressor.

9. The method as claimed in claim 1, wherein said at least one compressor includes two or more compressors, the method further comprising the steps of:

assigning a ranking to each of said two or more compressor for defining a highest ranked compressor and a lowest ranked compressor; and transmitting a load signal from said host controller to the highest ranked compressor.

10. The method as claimed in claim 9, further comprising the steps of transmitting a load signal to one of said compressors ranked between the highest ranked compressor and the lowest ranked compressor.

11. The method as claimed in claim 10, further comprising the step of reordering the ranking assigned to each said compressor so that the lowest ranked compressor becomes the highest ranked compressor.

12. The method as claimed in claim 11, further comprising the step of repeating the reordering the ranking step after a predetermined period of time has elapsed.

13. The method as claimed in claim 1, further comprising the step of changing the modulation pressure range of the lowest ranked compressor.

14. The method as claimed in claim 13, wherein the step of changing the modulation pressure range of the lowest ranked compressor includes the steps of:

sending a new modulation command from the host controller to the compressor controller of the lowest ranked compressor;

after receiving the new modulation command, obtaining a new pressure reading of the compressed fluid discharged from the lowest ranked compressor;

sending the new pressure reading to the compressor controller of the lowest ranked compressor; and establishing the new modulation pressure range of the lowest ranked compressor based upon the new pressure reading.

15. The method as claimed in claim 14, wherein the new pressure reading is used as a lower end of the new modulation pressure range.

16. The method as claimed in claim 14, wherein the new pressure reading is used as an upper end of the new modulation pressure range.

17. The method as claimed in claim 14, wherein the new pressure reading is used as a mid-point of the new modulation pressure range.

* * * * *